US007844196B2

(12) United States Patent
Kita et al.

(10) Patent No.: US 7,844,196 B2
(45) Date of Patent: Nov. 30, 2010

(54) IMAGE FORMING APPARATUS

(75) Inventors: Nobuhiko Kita, Osaka (JP); Sei Onuma, Osaka (JP); Ryoh Idehara, Hyogo (JP); Kazuyoshi Kondo, Osaka (JP); Yuusuke Furuichi, Osaka (JP); Genta Hagiwara, Osaka (JP); Kaoru Tada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 12/232,450

(22) Filed: Sep. 17, 2008

(65) Prior Publication Data

US 2009/0080937 A1 Mar. 26, 2009

(30) Foreign Application Priority Data

Sep. 25, 2007 (JP) ..... 2007-246938

(51) Int. Cl.
*G03G 15/00* (2006.01)

(52) U.S. Cl. ..... 399/107; 399/118

(58) Field of Classification Search ..... 399/107, 399/110, 117–119, 126; 347/138, 152
See application file for complete search history.

(56) References Cited

U.S. PATENT DOCUMENTS 6,157,797 A * 12/2000 Saito et al. ..... 399/107
6,785,502 B2 8/2004 Kondoh
7,046,941 B2 * 5/2006 Kameyama et al. ..... 399/107
7,454,157 B2 * 11/2008 Yamada et al. ..... 399/116
2007/0110473 A1 5/2007 Kondo et al.
2007/0110475 A1 5/2007 Idehara et al.
2007/0166073 A1 7/2007 Idehara et al.
2007/0246638 A1 10/2007 Idehara et al.
2008/0007935 A1 1/2008 Kondo et al.
2008/0050146 A1 2/2008 Kita et al.
2008/0063425 A1 3/2008 Idehara et al.
2008/0075502 A1 3/2008 Tada et al.

FOREIGN PATENT DOCUMENTS

JP 06-043776 2/1994
JP 10-340011 12/1998
JP 2007-164141 6/2007

* cited by examiner

*Primary Examiner*—Hoan Tran
(74) *Attorney, Agent, or Firm*—Harness, Dickey, & Pierce, P.L.C.

(57) ABSTRACT

An image forming apparatus includes a holding mechanism that holds an optical writing unit such that, at an operating position, the latent image writing unit is supported at three points with respect to the apparatus main body, and the latent image writing unit and the rotation axis are not in contact with each other.

15 Claims, 7 Drawing Sheets

IMAGE FORMING APPARATUS

CROSS-REFERENCE TO RELATED APPLICATIONS

The present application claims priority to and incorporates by reference the entire contents of Japanese priority document 2007-246938 filed in Japan on Sep. 25, 2007.

BACKGROUND OF THE INVENTION

1. Field of the Invention

The present invention relates to an image forming apparatus such as a copier, a facsimile apparatus, a printer that can retract a latent image writing unit to a retracted position from an operating position.

2. Description of the Related Art

In typical electrophotographic image forming apparatuses, a configuration in which a latent image is written on a uniformly charged latent image carrier with a latent image writing unit has been widely adopted. The latent image carrier is generally a photosensitive body and the latent image writing unit is generally a laser writing device. In such image forming apparatuses, depending on a layout of the apparatus, maintainability of the latent image carrier and various types of peripheral devices such as a developing device disposed at the periphery of the latent image carrier may degrade because the optical writing unit comes in the way as an obstacle.

In Japanese Patent Application Laid-open No. 2007-164141, an image forming apparatus that includes an optical writing unit is disclosed. The optical writing unit moves between an operating position where a writing operation to write a latent image on a latent image carrier is carried out, and a retracted position where the writing operation is not carried out. With such a configuration, the latent image carrier and the peripheral devices can be exposed outside, by retracting the optical writing unit to the retracted position from the operating position opposed to the latent image carrier. Accordingly, the maintainability thereof can be improved.

FIG. 11 is a perspective view of an internal configuration of an image forming apparatus disclosed in the Japanese Patent Application Laid-open No. 2007-164141. As shown in FIG. 11, the image forming apparatus includes a holding frame 230 that is a holder for holding a casing 271 of an optical writing unit 270 that includes a polygon motor, a polygon mirror, and a reflecting mirror, which are not shown.

A first holding plate 232 of the holding frame 230 includes a first opening 232*a* and a second opening 232*b* arranged with a predetermined distance therebetween. A left side first alignment axis 271*a* protruding from a left side surface of the casing 271 is inserted through the first opening 232*a*, while allowing a certain degree of freedom therein. On the other hand, a left side second alignment axis 271*b* protruding from the left side surface of the casing 271 is inserted through the second opening 232*b*, while allowing a certain degree of freedom therein.

A second holding plate 233 of the holding frame 230 includes a first opening 233*a* and a second opening 233*b* arranged with a predetermined distance therebetween. A right side first alignment axis 271*c* protruding from a right side surface of the casing 271 is inserted through the first opening 233*a*, while allowing a certain degree of freedom therein. On the other hand, a right side second alignment axis 271*d* protruding from the right side surface of the casing 271 is inserted through the second opening 233*b*, while allowing a certain degree of freedom therein.

The first holding plate 232 and the second holding plate 233 are rotatably supported by a rotation axis 200 laid across a first support plate 280 and a second support plate 290 of the apparatus main body. By rotating the holding frame 230 around the rotation axis 200, it is possible to retract the optical writing unit 270 to a retracted position from an operating position.

A left side first optical alignment groove 281*a* and a left side second optical alignment groove 281*b* recessed by a predetermined depth are arranged with a predetermined distance therebetween, at an upper end of the first support plate 280. On the other hand, a right side first optical alignment groove 291*a* and a right side second optical alignment groove 291*b* recessed by a predetermined depth are arranged with a predetermined distance therebetween, at an upper end of the second support plate 290.

When the optical writing unit 270 is at the operating position, the optical writing unit 270 is supported by bringing each of the alignment axes 271*a* to 271*d* of the casing 271 pressed against the bottom surfaces of the corresponding optical alignment grooves 281*a*, 281*b*, 291*a*, and 291*b*, respectively. Accordingly, the optical writing unit 270 is aligned in a vertical direction.

In the Japanese Patent Application Laid-open No. 2007-164141, as shown in FIG. 12, an image forming apparatus in which the optical writing unit 270 is supported at three points at the operating position is also disclosed. More specifically, the alignment axes 271*a* and 271*c* are protruded from the left side surface and the right side surface of the casing 271, respectively. The alignment axes 271*a* and 271*c* are supported by bottom surfaces of the optical alignment grooves 281 and 291 provided at the top end of the first support plate 280 and the second support plate 290, respectively. A rotation axis engaging unit 271*e*, provided at the center in a left-right direction of the rear side plate of the casing, is engaged to the rotation axis 200, and the rotation axis 200 supports the casing 271 of the optical writing unit 270.

When the optical writing unit 270 is supported at four points as shown in FIG. 11, it is necessary to perform accurate alignment of the four support units. This may result in an increase in manufacturing cost and the like. When the optical writing unit 270 is supported at three points, as shown in FIG. 12, it is only necessary to perform accurate alignment at three points. Accordingly, it is possible to reduce manufacturing cost, compared with the optical writing unit supported at four points.

However, in the image forming apparatus shown in FIG. 12, one point among the three support points is supported by the rotation axis 200. Because the rotation axis 200 is less stiff compared with the side plate, when a disturbance, such as a user bumping into the apparatus main body occurs, the rotation axis 200 vibrates, and the vibration are disadvantageously transmitted to the casing 271. Consequently, the reflecting mirror and the like in the casing vibrate. If the reflecting mirror and the like vibrate, the reflection direction of light fluctuates, thereby shifting the irradiating position. As a result, problems such as color shifts occur.

SUMMARY OF THE INVENTION

It is an object of the present invention to at least partially solve the problems in the conventional technology.

According to an aspect of the present invention, there is provided an image forming apparatus including a latent image carrier that carries a latent image; a latent image writing unit that carries out a writing operation to writ the latent image on the latent image carrier; and a holding mechanism that holds the latent image writing unit, the holding mechanism being rotatable between an operating position and a retracted position around a rotation axis provided in an apparatus main body, the operating position being a position where the latent image writing unit carries out the writing operation and the retracted position being a position where the latent image writing unit does not carry out the writing operation. The holding mechanism, when at the operating position, holds the latent image writing unit such that the latent image writing unit is supported at three points with respect to the apparatus main body, and the latent image writing unit and the rotation axis are not in contact with each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

Figure 1:
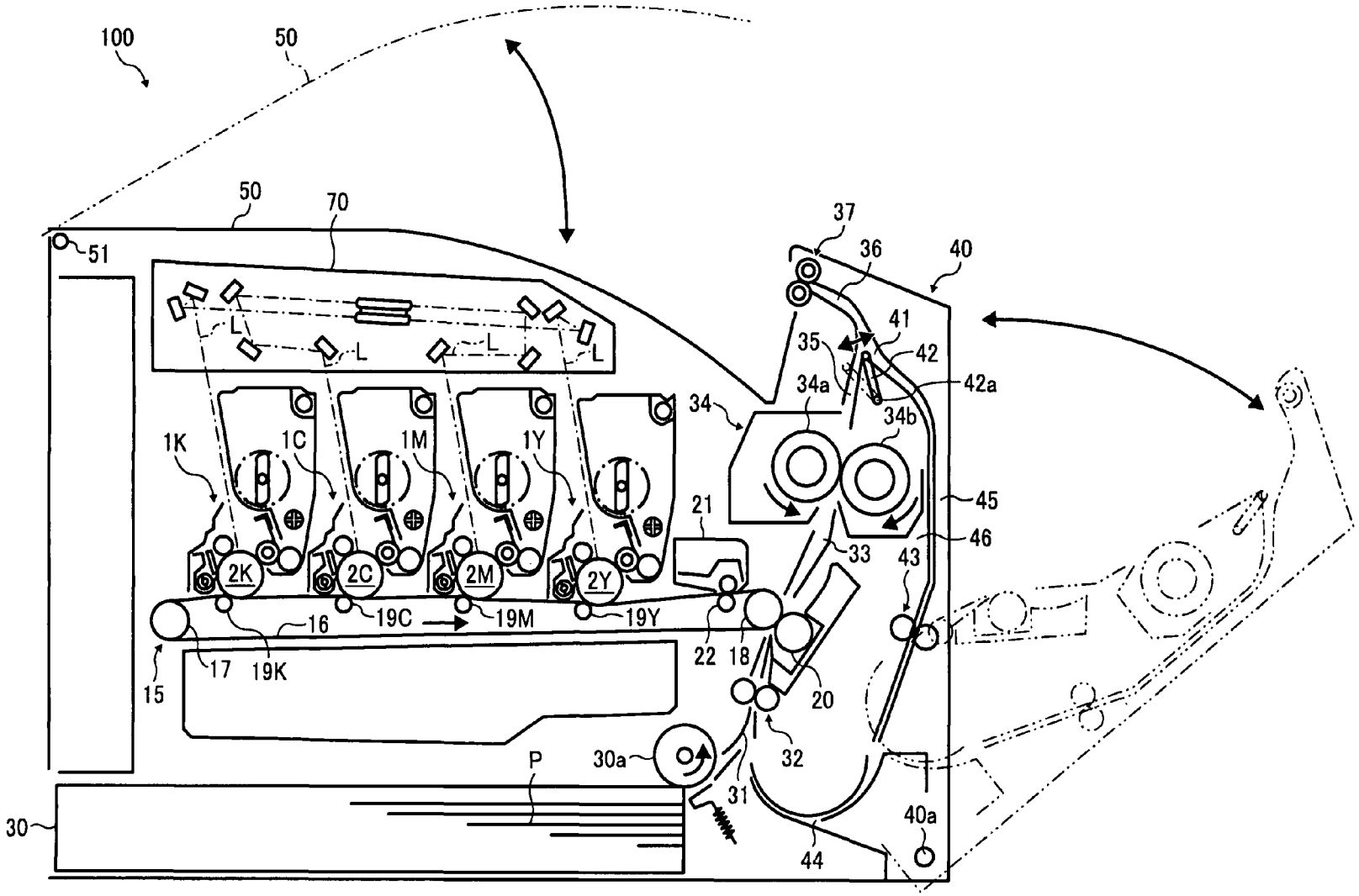
FIG. 1 is a schematic of a printer according to an embodiment of the present invention.
Figure 2:
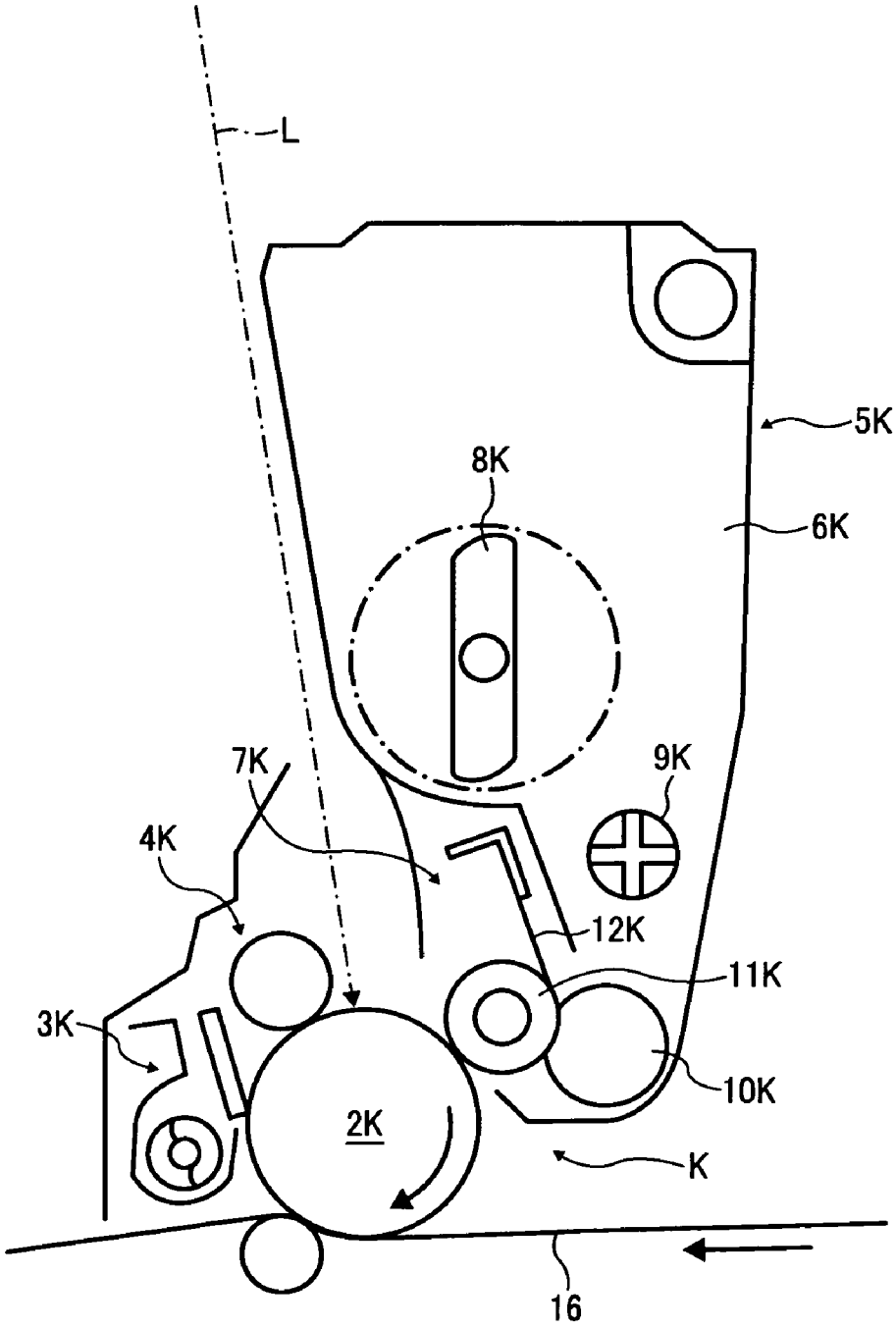
FIG. 2 is an enlarged schematic view of a process unit for black (K) of the printer.

FIG. 1 is a schematic of a printer 100 according to an embodiment of the present invention. The printer 100 includes four process units 1Y, 1M, 1C, and 1K that form toner images of yellow, magenta, cyan, and black (hereinafter, "Y, M, C, and K"). The four process units mutually use toners of different colors of Y, M, C, and K, otherwise they have the same or substantially similar configurations. The process units are replaced when the toner runs out. For example, as shown in FIG. 2, the process unit 1K that forms a K toner image includes a photosensitive body 2K that is a latent image carrier in a drum shape, a drum cleaning device 3K, a neutralizing device (not shown), a charger 4K, and a developing device 5K. The process unit 1K that is an image forming unit, is attachable and detachable to and from the printer main body, and consumables can be replaced at one time.

The charger 4K uniformly charges the surface of the photosensitive body 2K that rotates in a clockwise direction in FIG. 2, by a driving unit, which is not shown. The uniformly charged surface of the photosensitive body 2K is exposed and scanned by laser light L, and carries an electrostatic latent image for K thereon. The electrostatic latent image for K is developed into a K toner image, by the developing device 5K that uses a K toner, which is not shown. The K toner image is then intermediately transferred on an intermediate transfer belt 16, which will be described later. The drum cleaning device 3K removes a transfer residual toner that has remained on the surface of the photosensitive body 2K, after the intermediate transfer process is carried out. The neutralizing device neutralizes residual charges on the photosensitive body 2K after being cleaned. With the neutralization, the surface of the photosensitive body 2K is initialized, and is ready for the next image formation. With the process units 1Y, 1M, and 1C for the other colors, the toner images of Y, M, and C are also formed on the photosensitive bodies 2Y, 2M, and 2C in a similar way, and the toner images are intermediately transferred on the intermediate transfer belt 16, which will be explained later.

The developing device 5K includes a hopper unit 6K in a longitudinal shape that houses the K toner, which is not shown, and a developing unit 7K. The hopper unit 6K includes an agitator 8K rotatably driven by the driving unit, which is not shown, a stirring paddle 9K rotatably driven by the driving unit, which is not shown, in a vertically downward direction from the agitator 8K, a toner supplying roller 10K rotatably driven by the driving unit, which is not shown, in a vertical direction from the stirring paddle 9K, and the like. The K toner in the hopper unit 6K moves towards the toner supplying roller 10K due to the own weight of the K toner, while being stirred by the rotational drive of the agitator 8K and the stirring paddle 9K. The toner supplying roller 10K includes a core metal made of metal, and a roller unit made of foamed resin and the like, being covered on the surface thereof, and rotates while adhering the K toner in the hopper unit 6K onto the surface of the roller unit.

The developing unit 7K of the developing device 5K includes a developing roller 11K that rotates while coming into contact with the photosensitive body 2K and the toner supplying roller 10K, and a thinning blade 12K of which the tip comes into contact with the surface of the developing roller 11K. The K toner adhered onto the toner supplying roller 10K in the hopper unit 6K is supplied on the surface of the developing roller 11K at an abutment portion between the developing roller 11K and the toner supplying roller 10K. The layer thickness of the supplied K toner on the surface of the roller is regulated, when the K toner passes through the abutment position between the roller and the thinning blade 12K with the rotation of the developing roller 11K. The K toner, after the layer thickness is being regulated, is adhered on the electrostatic latent image for K on the surface of the photosensitive body 2K, at a developing region that is an abutment portion between the developing roller 11K and the photosensitive body 2K. With the adhesion, the electrostatic latent image for K is developed into the K toner image.

The process unit for K is explained with reference to FIG. 2. The similar process can be applied to the process units 1Y, 1M, and 1C to form the toner images of Y, M, and C on the surfaces of the photosensitive bodies 2Y, 2M, and 2C.

Referring back to FIG. 1, an optical writing unit 70 is disposed in a vertically upward direction from the process units 1Y, 1M, 1C, and 1K. The optical writing unit 70 is a latent image writing device that optically scans the photosensitive bodies 2Y, 2M, 2C, and 2K in the process units 1Y, 1M, 1C, and 1K, using the laser light L emitted from a laser diode based on image information. With the optical scanning, electrostatic latent images for Y, M, C, and K are formed on the photosensitive bodies 2Y, 2M, 2C, and 2K. The optical writing unit 70 irradiates a photosensitive body via a plurality of optical lenses and mirrors, with laser light L emitted from a light source, while polarizing the laser light L with the polygon mirror rotatably driven by the polygon motor, which is not shown, in a main-scanning direction.

A transferring unit 15 that stretches and endlessly moves the endless intermediate transfer belt 16 in an anti-clockwise direction in FIG. 1, is disposed in a vertically downward direction from the process units 1Y, 1M, 1C, and 1K. The transferring unit 15 includes a driving roller 18, a driven roller 17, four primary transfer rollers 19Y, 19M, 19C, and 19K, a secondary transfer roller 20, a belt cleaning device 21, and a cleaning backup roller 22, as well as the intermediate transfer belt 16.

The intermediate transfer belt 16 is stretched by the driving roller 18, the driven roller 17, the cleaning backup roller 22, and the four primary transfer rollers 19Y, 19M, 19C, and 19K disposed in the loop thereof. With the rotational force of the driving roller 18 rotated and driven in the anti-clockwise direction in FIG. 1, by the driving unit, which is not shown, the intermediate transfer belt 16 is endlessly moved in the anti-clockwise direction.

The four primary transfer rollers 19Y, 19M, 19C, and 19K hold the intermediate transfer belt 16 endlessly moved in this manner, between the photosensitive bodies 2Y, 2M, 2C, and 2K. Being held therebetween, primary transfer nips for Y, M, C, K, that allow the face of the intermediate transfer belt 16 to come into contact with the photosensitive bodies 2Y, 2M, 2C, and 2K are formed.

The primary transfer rollers 19Y, 19M, 19C, and 19K, are applied with a primary transfer bias, by a transfer bias supply, which is not shown, respectively. Accordingly, a transfer electric field is formed between the electrostatic latent images of the photosensitive bodies 2Y, 2M, 2C, and 2K, and the primary transfer rollers 19Y, 19M, 19C, and 19K. A transfer charger or a transfer brush may be adopted, instead of using the primary transfer rollers 19Y, 19M, 19C, and 19K.

When the Y toner formed on the surface of the photosensitive body 2Y of the process unit 1Y for Y enters the primary transfer nip for Y with the rotation of the photosensitive body 2Y, the Y toner is primarily transferred on the intermediate transfer belt 16 from the photosensitive body 2Y due to a transfer electric field and a nip pressure. When the intermediate transfer belt 16 that the Y toner image is primarily transferred thereto in this manner, passes through the primary transfer nips for M, C, and K with the endless movement, the toner images of M, C, and K on the photosensitive bodies 2M, 2C, and 2K are sequentially superimposed and primarily transferred onto the Y toner image. With the superimposition at the primary transfer, four toner images are formed on the intermediate transfer belt 16.

The secondary transfer roller 20 of the transferring unit 15 holds the intermediate transfer belt 16 with the driven roller 17 in the loop, while being disposed outside the loop of the intermediate transfer belt 16. Being held therebetween, a secondary transfer nip that allows the face of the intermediate transfer belt 16 to come into contact with the secondary transfer roller 20 is formed. The secondary transfer roller 20 is applied with a secondary transfer bias, by the transfer bias supply, which is not shown. Being applied with the secondary transfer bias, a secondary transfer electric field is formed between the secondary transfer roller 20 and the driven roller connected to ground.

A paper supply cassette 30 that houses recording paper P of a plurality of stacked sheets is slidably and attachably/detachably disposed with respect to a casing of the printer 100, in a vertically downward direction from the transferring unit 15. In the paper supply cassette 30, a paper supplying roller 30*a* comes into contact with the recording paper P at the top of the stacked sheets, and the recording paper P is fed towards a paper supply path 31, by rotating the paper supplying roller 30*a* in the anti-clockwise direction in FIG. 1, at a predetermined timing.

Near the end of the paper supply path 31, a pair of registration rollers 32 is disposed. The pair of registration rollers 32 stops rotating, as soon as the recording paper P fed from the paper supply cassette 30 is held between the rollers. Then, at the timing that the recording paper P held therebetween can be synchronized with the toner images of four colors on the intermediate transfer belt 16, in the secondary transfer nip, the pair of registration rollers 32 resumes the rotational drive, and feeds the recording paper P towards the secondary transfer nip.

The toner images of four colors on the intermediate transfer belt 16 that come in close contact with the recording paper P in the secondary transfer nip, are secondarily transferred onto the recording paper P collectively, being affected by the secondary transfer electric field and a nip pressure. Combined with the white of the recording paper P, the toner images of four colors become a full color toner image. The recording paper P on which surface the full color toner image is formed in this manner, is curvature-separated from the secondary transfer roller 20 and the intermediate transfer belt 16, when being passed through the secondary transfer nip. The recording paper P is then fed into a fixing device 34, which will be explained later, via a post-transfer conveying path 33.

On the intermediate transfer belt 16 that has passed through the secondary transfer nip, the transfer residual toner not transferred onto the recording paper P is adhered. The transfer residual toner is cleaned from the surface of the belt, by the belt cleaning device 21 that comes into contact with the face of the intermediate transfer belt 16. The cleaning backup roller 22 disposed in the loop of the intermediate transfer belt 16 backs up the cleaning of the belt performed by the belt cleaning device 21 from inside the loop.

The fixing device 34 forms a fixing nip with a fixing roller 34*a* that includes a heating source such as a halogen lamp, which is not shown, and a pressure roller 34*b* that rotates while coming into contact with the fixing roller 34*a* at a predetermined pressure. The recording paper P fed into the fixing device 34 is held by the fixing nip, so that the surface that carries the unfixed toner image comes in close contact with the fixing roller 34*a*. Being affected by the heat and the pressure, the toner in the toner image is softened, thereby fixing the full color image.

The recording paper P discharged from the fixing device 34 comes to a branch point between a paper discharge path 36 and a pre-reverse conveying path 41, after passing through a post-fixing conveying path 35. At the side of the post-fixing conveying path 35, a switch pawl 42 rotationally driven around a rotation axis 42*a* is disposed, and an area near the end of the post-fixing conveying path 35 is closed and opened due to the rotation. At the timing that the recording paper P is fed out from the fixing device 34, as shown in FIG. 1, the switch pawl 42 is stopped at the rotation position shown in a solid line, thereby opening the area near the end of the post-fixing conveying path 35. Accordingly, the recording paper P enters into the paper discharge path 36 from the post-fixing conveying path 35, and is held between the rollers of a pair of paper discharging rollers 37.

When a single-sided print mode is being set, the recording paper P held between the pair of paper discharging rollers 37 is discharged directly outside the machine. The single-sided print mode may be set by an input operation with respect to an operating unit formed by a numeric keypad and the like, which are not shown, and by a controlling signal and the like sent from a personal computer and the like, which are not shown. The recording paper P is then stacked in a stacking unit at the top surface of an upper cover 50 of the casing.

When a double-sided print mode is being set, after the rear edge side of the recording paper P, of which the tip edge side is conveyed in the paper discharge path 36 by being held between the pair of paper discharging rollers 37, passes through the post-fixing conveying path 35, the switch pawl 42 rotates to the position of a broken line in FIG. 1, and closes the area near the end of the post-fixing conveying path 35. At the same time, a path from the paper discharge path 36 to the pre-reverse conveying path 41 is connected by the switch pawl 42. Nearly at the same time, the pair of paper discharging rollers 37 starts to rotate in reverse. The recording paper P is then conveyed with the rear edge side towards the front, and enters into the pre-reverse conveying path 41.

FIG. 1 is a schematic front side view of the printer 100. The front surface of the printer 100 is located at the near side in a direction substantially perpendicular to the paper surface, and the rear surface is located at the far side. The right surface of the printer 100 is located at the right side in FIG. 1, and the left surface is located at the left side. The right end of the printer 100 is a reversing unit 40 that can open and close with respect to the casing main body, by rotating around a rotation axis 40*a*. When the pair of paper discharging rollers 37 rotates in reverse, the recording paper P enters into the pre-reverse conveying path 41 of the reversing unit 40, and conveyed vertically downward. The recording paper P, after passing through the rollers of a pair of reverse conveying rollers 43, enters into a reverse conveying path 44 curved in a semicircle. The top and the bottom surfaces of the recording paper P are reversed, while being conveyed along the curve, and the traveling direction vertically downward from above is also reversed, so that the recording paper P is conveyed vertically upward from below. After passing through the paper supply path 31, the recording paper P is re-entered into the secondary transfer nip. The full color image is secondarily transferred also onto the other side of the recording paper P collectively. The recording paper P is then discharged outside the machine, after sequentially passing through the post-transfer conveying path 33, the fixing device 34, the post-fixing conveying path 35, the paper discharge path 36, and the pair of paper discharging rollers 37.

The reversing unit 40 includes an outside cover 45 and an oscillating body 46. More specifically, the outside cover 45 of the reversing unit 40 is supported so as to rotate around the rotation axis 40*a* disposed in the casing of the printer main body. With this rotation, the outside cover 45 opens and closes with respect to the casing, along with the oscillating body 46 included therein. As shown in the broken line in FIG. 1, when the outside cover 45 is opened with the oscillating body 46 therein, the paper supply path 31, the secondary transfer nip, the post-transfer conveying path 33, the fixing nip, the post-fixing conveying path 35, and the paper discharge path 36 all formed between the reversing unit 40 and the printer main body are vertically halved and are exposed outside. Accordingly, the paper jammed inside the paper supply path 31, the secondary transfer nip, the post-transfer conveying path 33, the fixing nip, the post-fixing conveying path 35, and the paper discharge path 36 can be easily removed therefrom.

The oscillating body 46 is supported by the outside cover 45 so as to rotate around an oscillating axis, which is not shown, included in the outside cover 45, while the outside cover 45 is being opened. With this rotation, when the oscillating body 46 is opened with respect to the outside cover 45, the pre-reverse conveying path 41 and the reverse conveying path 44 are vertically halved and are exposed to outside. Accordingly, the paper jammed in the pre-reverse conveying path 41 and the reverse conveying path 44 can easily be removed therefrom.

The upper cover 50 of the casing of the printer 100, as shown by an arrow in FIG. 1, is rotatably supported around a rotation axis 51, and is opened with respect to the casing, by rotating in the anti-clockwise direction in FIG. 1. An upper opening of the casing is widely exposed to outside. Accordingly, the optical writing unit 70 is exposed.

Characteristic configurations of the printer 100 will now be explained.

Referring back to FIG. 1, even if the upper cover 50 of the casing is opened, because the four process units 1Y, 1M, 1C, and 1K are positioned immediately below the optical writing unit 70, which is at the top most position, the four process units 1Y, 1M, 1C, and 1K cannot be seen from the above. Because the optical writing unit 70 is in the way, the process units cannot be maintained from the upper opening emerged by opening the upper cover 50.

Accordingly, with the printer 100, the optical writing unit 70 is held in a holding frame 130, and as required, the holding frame is retracted from an operating position, which is immediately above the four process units 1Y, 1M, 1C, and 1K, along with the optical writing unit 70, thereby exposing the process units.

Figure 3:
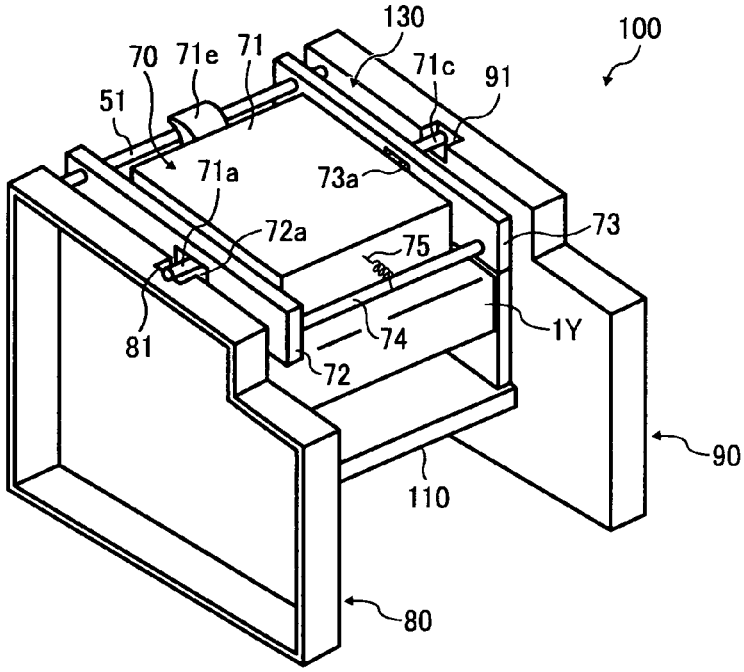
FIG. 3 is a perspective view of an optical writing unit in an operating position.
Figure 4:
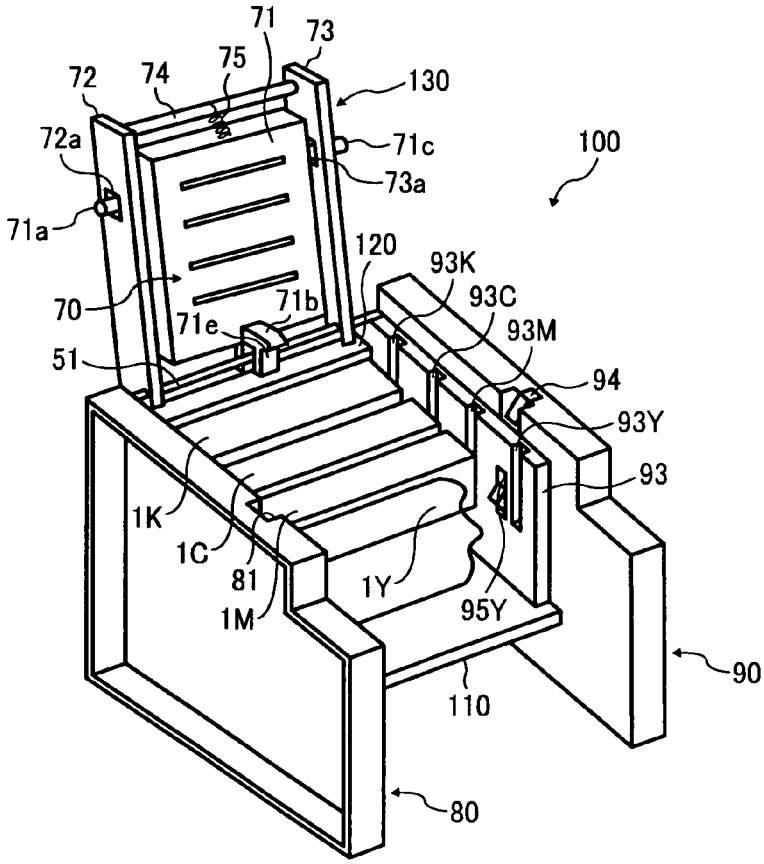
FIG. 4 is a perspective view of the optical writing unit in a retracted position.
Figure 5A:
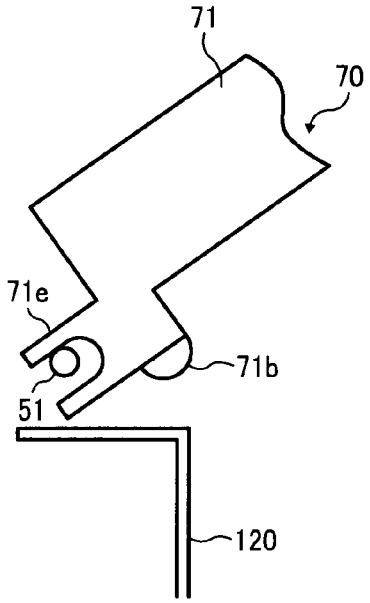
FIGS. 5A and 5B are enlarged schematic views of essential parts around a rear side plate.
Figure 5B:
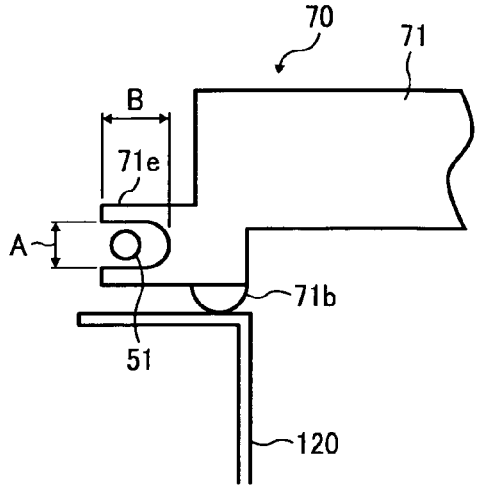

FIG. 3 is a perspective view of the optical writing unit 70 in an operating position. FIG. 4 is a perspective view of the optical writing unit 70 in a retracted position. FIGS. 5A and 5B are enlarged schematic views of essential parts around a rear side plate 120.

As shown in FIGS. 3 and 4, a main body frame that supports various units is placed in the casing of the printer 100. The main body frame includes a left side plate 80 that is a first support plate, a right side plate 90 that is a second support plate, a front side plate, which is not shown, a beam plate 110, and the rear side plate 120 that is a perpendicular plate. The left side plate 80 and the right side plate 90 are coupled through the rear side plate 120, so as to be disposed in an upright manner, while facing each other with a predetermined distance therebetween. The left side plate 80 and the right side plate 90 are coupled through the beam plate 110 disposed therebetween. Although not shown, the left side plate 80 supports a photosensitive body driving motor that is a driving source for driving a photosensitive body, a drive transmission device that transmits the drive of the photosensitive body driving motor to the photosensitive body, and the like.

The left side plate 80, the right side plate 90, and the beam plate 110 may be an integral structure integrally formed of resin. The number of components can be reduced by being integrally formed.

Between the left side plate 80 and the right side plate 90 facing each other with a predetermined distance, the transfer unit, which is not shown, there is a room for disposing the four process units, the optical writing unit 70 that is a latent image writing unit, the holding frame 130 that is a holder, and the like.

At the upper end portion of the left side plate 80, a left side optical alignment groove 81 with a predetermined depth is formed. At the upper end portion of the right side plate 90, a right side optical alignment groove 91 recessed by a predetermined depth is formed. The right side optical alignment groove 91 of the right side plate 90 includes a leaf spring 94.

To the right side plate 90, at the surface facing the left side plate 80, a right side image forming support unit 93 is being protruded. The right side image forming support unit 93 is integrally formed with the main body of the right side plate 90, and the main body and the right side image forming support unit 93 are both made of resin. Four right side image forming alignment grooves 93Y, 93M, 93C, and 93Y extended to the lower end from the upper end are formed in the right side image forming support unit 93. Although not shown in FIG. 4, a left side image forming support unit that includes the similar four left side image forming alignment grooves is formed on the left side plate 80 of the main body frame, at the surface facing the right side plate 90.

The photosensitive bodies 2Y, 2M, 2C, and 2K, which are not shown, of the four process units 1Y, 1M, 1C, and 1K include a drum unit, which is a cylinder, and a left drum axis and a right drum axis that are axes protruded from the both end surfaces in a direction of the axis of the drum unit, respectively. The process units 1Y, 1M, 1C, and 1K, protrude the left drum axis and the right drum axis outside the casing, through an axis hole, which is not shown, provided in the casing. While engaging the left drum axis of each of the process units in the left side image forming alignment grooves, which are not shown, in the left side image forming support unit of the left side plate 80 of the main body frame, the right drum axis is engaged in the right side image forming alignment grooves 93Y, 93M, 93C, and 93K in the right side image forming support unit of the right side plate 90 of the main body frame. With these engagements, each of the process units 1Y, 1M, 1C, and 1K is aligned in a front-rear direction. The process units 1Y, 1M, 1C, and 1K are supported by the left side plate 80 and the right side plate 90, and aligned in the vertical direction, because the left drum axis comes into contact with bottom surfaces of the left side image forming alignment grooves, and the right drum axis comes into contact with bottom surfaces of the right side image forming alignment grooves 93Y, 93M, 93C, and 93K.

Four leaf springs 95Y, 95M, 95C, and 95K are provided on the right side image forming support unit 93 (only leaf spring 95Y is shown in FIG. 4). By using each of the leaf springs 95Y, 95M, 95C, and 95K, each of the process units 1Y, 1M, 1C, and 1K is aligned in a left-right direction, by bringing the corresponding process units 1Y, 1M, 1C, and 1K pressed against the left side image forming support unit.

The optical writing unit 70 includes a casing 71 containing an optical system including a polygon motor, a polygon mirror, a reflecting mirror, a lens, and the like, which are not shown, and the casing 71 is held in the holding frame 130.

The holding frame 130 includes a left holding plate 72, a right holding plate 73, a front coupling rod 74, and a tension coil spring 75.

The area near the front end portion of the left holding plate 72 and the right holding plate 73 of the holding frame 130 are connected by the front coupling rod 74, so that the left holding plate 72 and the right holding plate 73 face each other with a predetermined distance therebetween, in the front-rear direction of the printer 100. The left holding plate 72 and the right holding plate 73 are rotatably fitted to the rotation axis 51. At the lower surfaces of the left holding plate 72 and the right holding plate 73 of the holding frame 130, four coil springs that correspond to the process units are fixed thereto, although not shown. When the holding frame 130 is at the operating position, each of the coil springs comes into contact with the upper surface of the corresponding process unit, and urges each of the process units downwards.

A left side alignment axis 71*a* protrudes from the left side surface of the casing 71 of the optical writing unit 70. A right side alignment axis 71*c* protrudes from the right side surface of the casing 71. A rotation axis engaging unit 71*e* is provided at the center of the rear wall of the casing 71, in a direction that the side plates are opposed to each other (left-right direction). The rotation axis engaging unit 71*e*, as shown in FIGS. 5A and 5B, includes a U-shaped notch portion. A distance A in a vertical direction and a distance B in a horizontal direction of the notch portion are set, so that the rotation axis 51 and the engaging unit 71*e* do not come into contact with each other, when the optical writing unit 70 is at the operating position (see FIG. 5B). On the other hand, as shown in FIG. 5A, when the optical writing unit 70 is moved to the retracted position from the operating position, the engaging unit 71*e* is engaged with the rotation axis 51. Accordingly, the optical writing unit 70 is supported by the rotation axis 51, at the retracted position.

A support protrusion 71*b* is provided at the lower surface of the engaging unit 71*e*, and as shown in FIG. 5B, the support protrusion 71*b* comes into contact with the upper surface of the rear side plate 120, at the operating position.

As shown in FIG. 3, one end of the tension coil spring 75 is fixed at the center of the in a longitudinal direction of the front coupling rod 74 that connects the left holding plate 72 and the right holding plate 73. The other end of the tension coil spring is fixed to the front surface of the casing 71. Accordingly, the optical writing unit 70 between the left holding plate 72 and the right holding plate 73 is pulled forward from the rear side of the printer 100.

The left holding plate 72 includes an opening 72*a*, and the left side alignment axis 71*a* protruded from the left side surface of the casing 71 is penetrated through the opening 72*a*. The right holding plate 73 includes an opening 73*a*, and the right side alignment axis 71*c* protruded from the right side surface of the casing 71 is penetrated therethrough.

The optical writing unit 70 is held in the holding frame 130, by having each of the alignment axes 71*a* and 71*c* of the casing 71 of the optical writing unit 70 penetrated through the openings in the left holding plate 72 and the right holding plate 73 of the holding frame 130, while allowing a certain degree of freedom therein. The opening 72*a* of the left holding plate 72 and the opening 73*a* of the right holding plate 73 are opened in an oval shape, because the end of the U-shaped notch portion provided on the holding plates 72 and 73 is closed by a notch end closing member. The notch end closing member is screwed onto each of the holding plates 72 and 73, and may be removed from the holding plates by being unscrewed. The optical writing unit 70 can be set between the left holding plate 72 and the right holding plate 73, by removing the notch end closing member from the holding plates 72 and 73, thereby forming the opening into the U-shaped notch portion. After inserting each of the alignment axes of the optical writing unit 70 into the U-shaped notch portion of the holding plates 72 and 73, each notch is opened by fitting the notch end closing member therein. In this manner, the optical writing unit 70 is held in the holding frame 130.

Before the optical writing unit 70 held in the holding frame 130 is set in the printer 100, the rotation axis 51 shown in FIG. 3 laid across the right side plate 90 and the left side plate 80 of the main body frame, which is a support body, is not yet present. At this state, the holding frame 130 that holds the optical writing unit 70 is put in between the right side plate 90, which is the first support plate, and the left side plate 80, which is the second support plate. At this time, the left side alignment axis 71*a* of the casing 71 of the optical writing unit 70 is inserted into the left side optical alignment groove 81 of the left side plate 80. The right side alignment axis 71*c* of the casing 71 is inserted into the right side optical alignment groove 91 of the right side plate 90. As shown in FIG. 5B, the support protrusion 71*b* is brought into contact with the upper surface of the rear side plate 120.

After putting the optical writing unit 70 in between the right side plate 90 and the left side plate 80 in this manner, the rotation axis 51 is inserted therein. More specifically, the rotation axis 51 is inserted into a hole provided in the left side plate 80, which is not shown, a hole provided in the left holding plate 72 of the holding frame 130, which is not shown, a hole in the upper cover 50, which is not shown, a hole provided in the right holding plate 73, which is not shown, and a hole provided in the right side plate 90, which is not shown. The left end portion of the rotation axis 51 is fixed to the left side plate 80 by a flange, an E-ring, an insert pin, and the like, and the right end portion is fixed to the right side plate 90.

The alignment axes 71*a* and 71*c* of the casing 71 of the optical writing unit 70 are brought into contact with the bottom surfaces of the corresponding optical alignment grooves 81 and 91, and the support protrusion 71*b* provided on the engaging unit 71*e* of the casing 71 is brought into contact with the upper surface of the rear side plate 120. Accordingly, the optical writing unit 70 is supported at three points of the left side plate 80 (the first support plate), the right side plate 90 (the second support plate), and the rear side plate 120 (the perpendicular plate) of the apparatus main body, and also aligned in the vertical direction.

The optical writing unit 70 is aligned in the front-rear direction, by pulling the optical writing unit 70 forward by the tension coil spring 75, and bringing each of the alignment axes 71*a* and 71*c* pressed against the front inner walls of the optical alignment grooves 81 and 91. In other words, in the present embodiment, a first alignment unit that aligns the optical writing unit 70 in a direction substantially perpendicular (front-rear direction) with respect to the rear side plate 120 (the perpendicular plate) includes each of the alignment axes 71*a* and 71*c* of the casing 71, the front inner walls of the optical alignment grooves 81 and 91, and the tension coil spring 75.

The optical writing unit 70 is aligned in the left-right direction, by moving the optical writing unit 70 to the side of the left side plate where the photosensitive body is supported. This is enabled by urging the right side alignment axis 71*c* of the casing 71 towards the side of the left side plate 80 using the leaf spring 94, and bringing the optical writing unit 70 pressed against the left holding plate 72. In other words, in the present embodiment, a second alignment unit that aligns the optical writing unit in a direction substantially perpendicular (left-right direction) with respect to the left side plate 80 (the first support plate) or the right side plate 90 (the second support plate) includes the right side alignment axis 71*c* of the casing 71, the leaf spring 94, and the left holding plate 72 of the holding frame 130.

The holding frame 130 set between the left side plate 80 and the right side plate 90 can slide and rotate with the optical writing unit 70, around the rotation axis 51 laid across the left side plate 80 (the first support plate) and the right side plate 90 (the second support plate). More specifically, each of the alignment axes 71*a* and 71*c* of the casing 71 of the optical writing unit 70 is formed smaller than the width of the corresponding optical alignment grooves 81 and 91, thereby moving in a direction of the groove width within the groove. However, when the optical writing unit 70 is being set at the operating position as shown in FIG. 3, each of the alignment axes 71*a* and 71*c* is pressed against the front inner walls of the optical alignment grooves, by being pulled forward of the printer 100, due to the tension of the tension coil spring 75. When the holding frame 130 is rotated in the anti-clockwise direction around the rotation axis 51 from the state in FIG. 3, the alignment axes 71*a* and 71*c* of the casing 71 move vertically upwards from below within the groove, while sliding the front inner walls of the corresponding optical alignment grooves 81 and 91, respectively. Eventually, the alignment axes 71*a* and 71*c* move out from the grooves. As shown in FIG. 4, in a process that the holding frame 130 holds the optical writing unit 70 and is retracted to the retracted position at approximately 11 o'clock position, as shown in FIG. 5A, the optical writing unit 70 lowers due to the own weight of the optical writing unit 70, against the tension of the tension coil spring, and the notch portion of the engaging unit 71*e* of the casing 71 is engaged with the rotation axis 51. Accordingly, it is possible to prevent the optical writing unit 70 from wobbling in the holding frame while being rotated. When the optical writing unit 70 is retracted to the retracted position as shown in FIG. 4 with the holding frame 130, the optical writing unit 70 is engaged thereto by an engaging mechanism, which is not shown. Accordingly, the four process units 1Y, 1M, 1C, and 1K positioned immediately below the optical writing unit 70 are exposed.

As shown in FIG. 4, by retracting the optical writing unit 70 to the retracted position, and widely exposing the process units 1Y, 1M, 1C, and 1K of each color, the process units 1Y, 1M, 1C, and 1K can be easily attached and detached thereto and therefrom. When the toner in the developing device is consumed, the process units 1Y, 1M, 1C, and 1K will be replaced by new process units.

In the printer 100, the optical writing unit 70 is supported at three points. Thus, it is possible to accurately align the optical writing unit 70 in the vertical direction, by only performing alignment of six locations. Those locations are the bottom surfaces of the optical alignment grooves 81 and 91, the upper surface of the rear side plate, the alignment axes 71*a* and 71*c* of the optical writing unit 70, and the support protrusion 71*b*. Therefore, compared with an optical writing unit supported at four points, the number of support points is reduced, thereby reducing the locations to perform accurate alignment. Accordingly, it is possible to manufacture the apparatus at a low cost.

The alignment of the optical writing unit 70 in the rotating direction around a virtual axis that extends in the front-rear direction can be carried out, by supporting the optical writing unit 70 with the left side plate 80 and the right side plate 90. The alignment of the optical writing unit 70 in the rotating direction around a virtual axis that extends in the left-right direction can be carried out, by supporting the optical writing unit 70 with the rear side plate 120.

In the printer 100, when the optical writing unit 70 is at the operating position, the notch portion of the engaging unit 71*e* is set so as not to come into contact with the rotation axis 51. Accordingly, even if a user bumps into the upper cover 50 while an image is being formed, and makes the rotation axis 51 bent and vibrated, the vibration of the rotation axis is not directly transmitted to the optical writing unit 70. Accordingly, it is possible to prevent the optical writing unit 70 from vibrating, thereby preventing the writing position from shifting. As a result, it is possible to prevent occurrence of abnormal images such as color shifts and banding.

As shown in FIGS. 5A and 5B, the rotation axis 51 is disposed so that a part of a projected shape in the vertical direction is overlapped with the rear side plate 120, above the rear side plate 120 (the perpendicular plate). Accordingly, the support protrusion 71*b* and the engaging unit 71*e* can be disposed close to each other. For example, when the optical writing unit 70 is obliquely supported, the displacement of the engaging unit 71*e* in the vertical direction increases, if the distance between the engaging unit 71*e* and the support protrusion 71*b* is further apart, compared with an arrangement that the distance between the engaging unit 71*e* and the support protrusion 71*b* is close. As a result, if the distance A of the notch portion of the engaging unit 71*e* in the vertical direction is small, the engaging unit 71*e* and the rotation axis 51 come into contact with each other, at the operating position. Consequently, the vibration of the rotation axis 51 is directly transmitted to the optical writing unit 70. If the distance A of the notch portion of the engaging unit 71*e* in the vertical direction is increased, the optical writing unit 70 wobbles in the holding frame, while being rotated to the retracted position from the operating position.

If the distance between the support protrusion 71*b* and the engaging unit 71*e* is close, it is possible to reduce the displacement of the engaging unit 71*e* in the vertical direction, when the optical writing unit 70 is obliquely supported. Accordingly, even if the distance A of the notch portion of the engaging unit 71*e* in the vertical direction is small, it is possible to prevent the rotation axis 51 and the engaging unit 71*e* from coming into contact with each other, at the operating position. As a result, it is possible to set the distance A of the notch portion of the engaging unit 71*e* in the vertical direction, in a range that the optical writing unit 70 does not wobble in the holding frame, while being rotated to the retracted position from the operating position. By disposing the rotation axis 51 so that a part of the projected shape in the vertical direction is overlapped with the rear side plate 120, above the upper surface of the rear side plate 120 (the perpendicular plate), the support protrusion 71*b* and the engaging unit 71*e* can be disposed close to each other. Accordingly, even if the optical writing unit 70 is obliquely supported, it is possible to prevent the rotation axis 51 and the engaging unit 71*e* from coming into contact with each other, at the operating position.

In the printer 100, the left side plate 80 is formed so that the left drum axes of the photosensitive bodies 2Y, 2M, 2C, and 2K are slidably and movably engaged towards the operating position of the optical writing unit 70, with respect to their respective left side image forming alignment grooves of the printer 100, which are not shown, and the engagement with the left drum axes is cancelled by removing the left drum axes that slidably moved a predetermined distance towards the operating position, from the upper end portions of the left side image forming alignment grooves. The right side plate 90 is formed so that the right drum axes of the photosensitive bodies 2Y, 2M, 2C, and 2K are slidably and movably engaged towards the operating position of the optical writing unit 70, with respect to their respective right side image forming alignment grooves 93Y, 93M, 93C, and 93K of the printer 100, and the engagement with the right drum axes is cancelled by removing the right drum axes that slidably moved a predetermined distance towards the operating position, from the upper end portions of the right side image forming alignment grooves 93Y, 93M, 93C, and 93K. In such a configuration, the photosensitive bodies 2Y, 2M, 2C, and 2K can be easily attached and detached with respect to the left side plate 80 and the right side plate 90, by slidably moving each of the photosensitive bodies 2Y, 2M, 2C, and 2K toward the operating position where the optical writing unit 70 being an obstacle is rotationally moved and removed, or by slidably moving thereof in the reverse direction.

In the printer 100, the optical writing unit 70 is an optical writing unit that can serve as one unit to write a latent image with respect to the four photosensitive bodies 2Y, 2M, 2C, and 2K. With such a configuration, unlike when an exclusive optical writing device is provided for optically writing an image in the photosensitive bodies 2Y, 2M, 2C, and 2K, it is possible to determine the optical writing position with respect to each of the photosensitive bodies 2Y, 2M, 2C, and 2K, by aligning one unit. Accordingly, it is possible to further simplify the alignment operation and the setting operation of the optical writing device, thereby improving the maintainability.

In this manner, the optical writing unit 70 moves between the operating position opposed to the four process units 1Y, 1M, 1C, and 1K, and the retracted position not opposed thereto, by rotating around the rotation axis 51 laid across the left side plate 80 and the right side plate 90. With such a configuration, the optical writing unit 70 is moved between the operating position and the retracted position, by fixing the sliding position with the rotation axis 51 in the optical writing unit 70, at the same position with respect to the left side plate 80 and the right side plate 90. Accordingly, it is possible to easily align the optical writing unit 70, compared with when the unit is slidably moved.

Figure 6A:
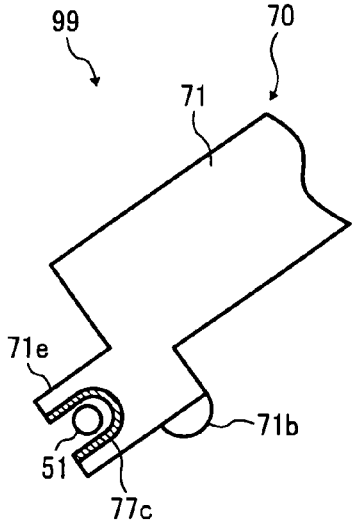
FIGS. 6A and 6B are schematics of the characteristic features of a printer according to a first modification.
Figure 6B:
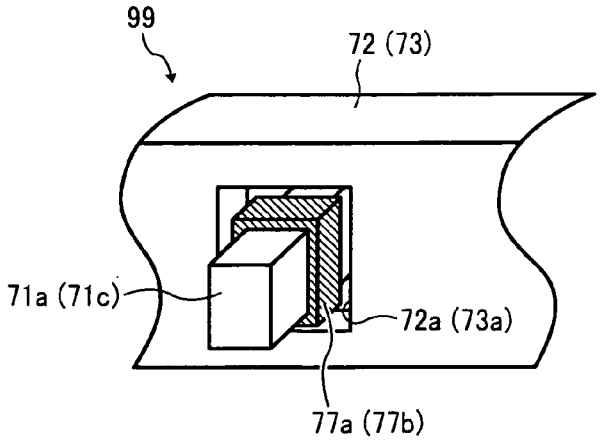

FIGS. 6A and 6B are schematics of the characteristic features of a printer 99 according to a first modification of the embodiment.

As shown in FIG. 6A, in the printer 99, an elastic member 77*c* is provided at the notch portion of the engaging unit 71*e*. As shown in FIG. 6B, elastic members 77*a* and 77*b* are also provided at the position opposed to the holding plates 72 and 73 of the alignment axes 71*a* and 71*c*.

In this manner, by providing the elastic members 77*a*, 77*b*, and 77*c*, it is possible to absorb an impact when the engaging unit 71*e* is pressed against the rotation axis 51, or when the alignment axes 71*a* and 71*c* are pressed against the rear walls of the openings 72*a* and 73*a* of the holding plates 72 and 73. The impact is caused because the optical writing unit 70 is moved to the side of the rear side plate, due to the own weight of the optical writing unit 70, while being rotated to the retracted position from the operating position. Thus, it is possible to soften the impact to the optical writing unit 70, thereby preventing the breakage of the optical writing unit 70.

Figure 7:
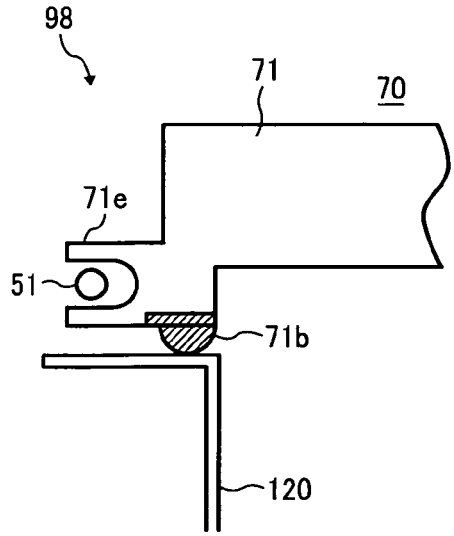
FIG. 7 is a schematic of the characteristic features of a printer according to a second modification.

FIG. 7 is a schematic of the characteristic features of the optical writing unit 70 in a printer 98 according to a second modification of the embodiment.

When the support protrusion 71*b* and the casing 71 are integrally formed, the height of the support protrusion 71*b* being high can be adjusted, for example, by scraping. However, when the height of the support protrusion 71*b* is low, the height cannot be adjusted.

In the printer 98 as shown in FIG. 7, the support protrusion 71*b* and the casing 71 of the optical writing unit 70 are formed separately. By separately forming the support protrusion 71*b* in this manner, even if the support protrusion 71*b* is low, it is possible to easily adjust the height. For example, the support protrusion 71*b* and the casing 71 can be fixed, by sandwiching a sheet material therebetween. Accordingly, it is possible to enhance the yield, compared with the support protrusion 71*b* and the casing 71 being integrally formed.

The support protrusion 71*b* is preferably made of material different from the casing 71, and it is especially preferable to form the support protrusion 71*b* by a slidable material. A glass fiber reinforced resin is used for the casing 71, to enhance the stiffness. When the optical writing unit 70 is aligned using the leaf spring 94 and the tension coil spring 75, by rotating the optical writing unit 70 to the operating position from the retracted position, the support protrusion 71*b* slides on the rear side plate 120. At this time, if the support protrusion 71*b* is made of the same glass fiber reinforced resin as that of the casing 71, the rear side plate 120 is scraped and abraded by the glass fiber of the support protrusion 71*b*. As a result, the abutment position between the support protrusion 71*b* and the rear side plate 120 may be abraded and recessed, thereby degrading the alignment accuracy. If the support protrusion 71*b* is formed of the material different from the casing 71, it is possible to prevent the abrasion of the rear side plate 120, thereby preventing degradation of the alignment accuracy. Particularly, the support protrusion 71*b* can move smoothly on the upper surface of the rear side plate 120, if the support protrusion 71*b* is made of a slidable material, thereby further preventing the abrasion of the rear side plate 120.

Figure 8:
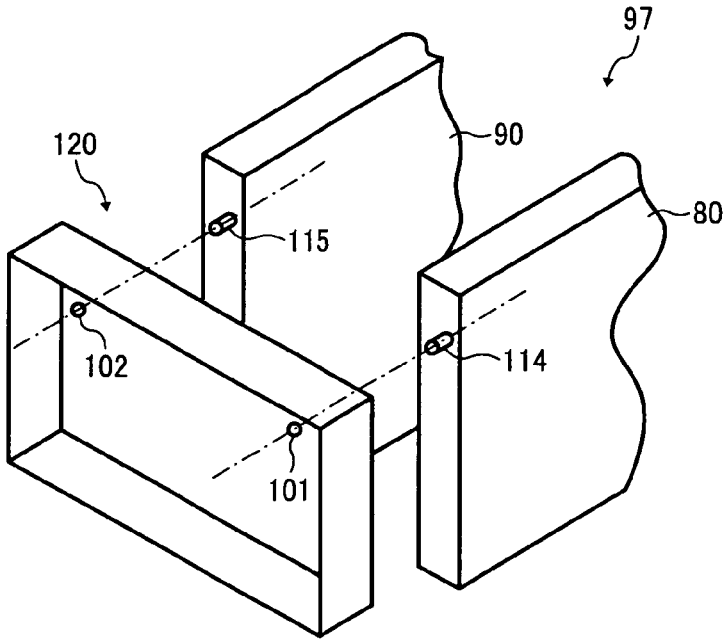
FIG. 8 is a schematic of the characteristic features of a printer according to a third modification.

FIG. 8 is a schematic of the characteristic features of a printer 97 according to a third modification of the embodiment.

As shown in FIG. 8, in the printer 97, a left side alignment boss 84 is provided at a surface opposed to the rear side plate 120 of the left side plate 80. A right side alignment boss 115 is provided at a surface opposed to the rear side plate 120 of the right side plate 90. The left side plate 80 and the right side plate 90 are attached to the rear side plate 120, by fitting the left side alignment boss 84 into a left side alignment hole 101 of the rear side plate 120, and fitting the right side alignment boss 115 into a right side alignment hole 102 of the rear side plate 120. The left side alignment boss 84 and the right side alignment boss 115 are provided at the same height from the installation surface.

Figure 9:
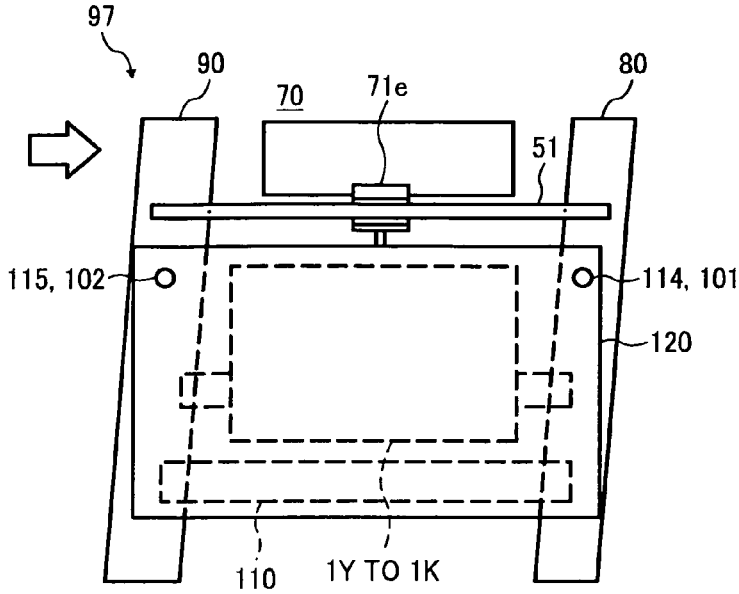
FIG. 9 is another schematic of the characteristic features of the printer according to the third modification.

FIG. 9 is a schematic of the internal configuration of the printer 97, when an external force is applied from the right side (left side in FIG. 9) of the printer 97.

As shown in FIG. 9, when an external force is applied, the right side plate 90 rotates around a fitting portion with the rear side plate 120, in a clockwise direction in FIG. 9. The right side plate 90 and the left side plate 80 may be fixed with the beam plate 110 by being screwed thereto, or the right side plate 90, the left side plate 80, and the beam plate 110 may be integrally formed by resin. Accordingly, when the right side plate 90 rotates, the left side plate 80 also rotates around the fitting portion with the rear side plate 120. At this time, the height of the installation surface of the fitting portion between the left side plate 80 and the rear side plate 120, is the same as the height of the installation surface of the fitting portion between the right side plate 90 and the rear side plate 120. Thus, the left side plate 80 rotates around the fitting portion at the same angle as the right side plate 90, in the clockwise direction in FIG. 9. In this manner, because the left side plate 80 rotates in the same direction and at the same angle with the right side plate 90, it is possible to maintain the parallel relationship between the rotation axis 51 and the notch portion of the engaging unit 71*e*. Because the parallel relationship between the rotation axis 51 and the notch portion of the engaging unit 71*e* can be maintained, it is possible to prevent the engaging unit 71*e* from coming into contact with the rotation axis 51, at the operating position, compared with an arrangement that the rotation axis 51 inclines with respect to the notch portion of the engaging unit 71*e*. As a result, it is possible to set the clearance between the rotation axis 51 and the notch portion of the engaging unit 71*e* in the vertical direction narrow, thereby preventing the optical writing unit 70 from wobbling in the holding frame, while the optical writing unit 70 is being rotated.

As shown in FIG. 9, when the right side plate 90 and the left side plate 80 are inclined, the rotation axis 51 moves relatively downwards with respect to the engaging unit 71*e*. However, because the rotation axis 51 is fitted parallel to the notch portion, which is the rotation axis engagement location, of the engaging unit 71*e*, even if the rotation axis 51 moves relatively downwards with respect to the engaging unit 71*e*, the rotation axis 51 is less likely to come into contact with the engaging unit 71*e*, compared with the rotation axis 51 obliquely fitted thereto. Accordingly, compared with the rotation axis 51 obliquely fitted with respect to the notch portion of the engaging unit 71*e*, it is possible to set the clearance between the rotation axis 51 and the notch portion of the engaging unit 71*e* in the vertical direction narrow.

In the printer 97, the rotation axis 51 is laid across the left side plate 80 and the right side plate 90, and the rotation axis 51 is supported by the left side plate 80 and the right side plate 90. However, the rotation axis 51 may be supported by the rear side plate 120. By supporting the rotation axis 51 with the rear side plate 120, as shown in FIG. 9, even if the left side plate 80 and the right side plate 90 are inclined, the positional relationship between the notch portion of the engaging unit 71*e* and the rotation axis 51 does not change. Accordingly, it is possible to set the clearance between the rotation axis 51 and the notch portion of the engaging unit 71*e* in the vertical direction, further narrower.

For example, when the installation surface is uneven and the position of the right side plate 90 or the left side plate 80 is lowered, the rear side plate 120, the rotation axis 51, and the optical writing unit 70 are inclined at the same angle, thereby keeping the parallel relationship between the rotation axis 51 and the engaging unit 71*e*.

Figure 10:
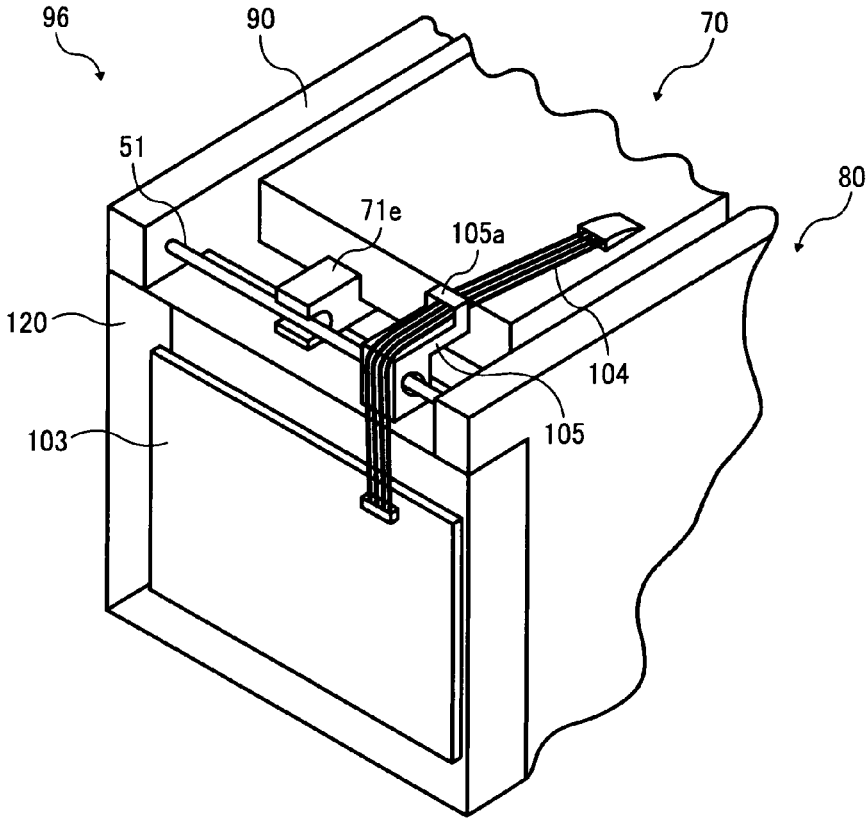
FIG. 10 is a perspective view of a printer according to a fourth modification.
Figure 11:
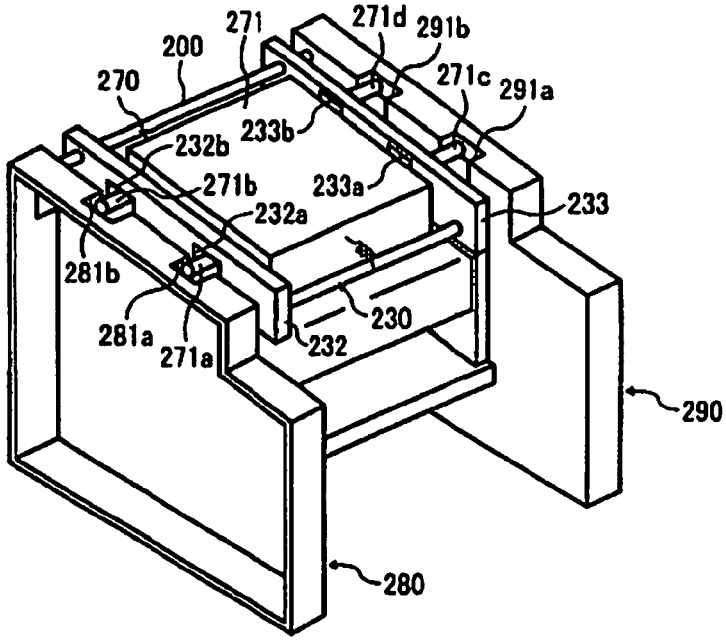
FIG. 11 (Related Art)
FIG. 11 is a schematic of an internal configuration of a conventional image forming apparatus.
Figure 12:
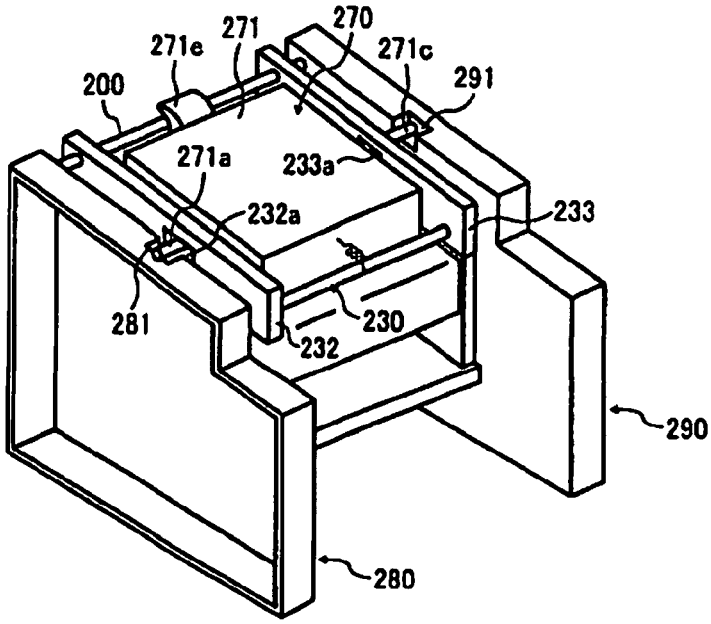
FIG. 12 (Related Art)
FIG. 12 is a schematic of an internal configuration of another conventional image forming apparatus.

FIG. 10 is a schematic of the characteristic features of a printer 96 according to a fourth modification of the present embodiment.

As shown in FIG. 10, in the printer 96, a controller 103 that is a controlling device to control the optical writing unit 70 is placed on the outside surface of the rear side plate 120. The rear side plate 120 of the fourth embodiment is enhanced in stiffness by forming a sheet metal into a box shape, thereby preventing electromagnetic noise emitted from the controller 103. The controller 103 and the optical writing unit 70 are electrically connected by a harness 104.

In this manner, by placing the controller 103 on the rear side plate 120, a housing case to house the controller 103 is unnecessary, thereby reducing the number of components.

A harness clamp 105 is rotatably fitted on the rotation axis 51, and the harness 104 between the rotation axis 51 and the optical writing unit 70 is fixed by a clamping unit 105*a* of the harness clamp 105. As shown in FIG. 10, when the optical writing unit 70 is at the operating position, the harness 104 connects the optical writing unit 70 and the controller 103 by being stretched over. However, when the optical writing unit 70 is at the retracted position, the harness 104 becomes loose. Accordingly, when the optical writing unit 70 is rotated and moved to the operating position in the state that the harness 104 is being loose, the harness 104 may be caught on the member in the apparatus, thereby pulling the optical writing unit 70 towards the side of the rear side plate 120. When the optical writing unit 70 is pulled by the harness 104, the engaging unit 71*e* may come into contact with the rotation axis 51, at the operating position.

However, in the printer 96, the harness 104 between the rotation axis 51 and the optical writing unit 70 is fixed by the harness clamp 105. Accordingly, while being at the rotation position, at least the harness 104 between the clamping unit 105*a* and the optical writing unit 70 does not get loose. Thus, even if the optical writing unit 70 is rotated to the operating position from the retracted position, the harness 104 therebetween will not be caught on the other members in the apparatus. As a result, the harness 104 does not pull the optical writing unit 70 towards the side of the rear side plate. The harness 104 between the clamping unit 105*a* and the controller 103 gets loose while being at the retracted position. Even if the harness 104 gets caught on the other members while the optical writing unit 70 is rotated to the operating position, the pulling force of the harness 104 is intercepted by the clamping unit 105*a*, thereby not reaching the optical writing unit 70. As a result, it is possible to prevent the optical writing unit 70 from being pulled towards the side of the rear side plate, at the operating position, and the engaging unit 71*e* from coming into contact with the rotation axis 51.

The printers 96 to 100, which are the image forming apparatuses, according to the present embodiment includes the photosensitive body 2, the optical writing unit 70, and the holding frame 130. The photosensitive body 2 is the latent image carrier that carries a latent image. The optical writing unit 70 is the latent image writing unit that writes the latent image on the photosensitive body. The holding frame 130 is the holder that can rotate between the operating position where the optical writing unit 70 carries out the writing operation to write a latent image on the surface of the photosensitive body, and the retracted position where the optical writing unit 70 does not carry out the writing operation, around the rotation axis 51 provided in the apparatus main body while holding the optical writing unit 70. When the holding frame 130 is at the operating position, the optical writing unit 70 is supported at three points with respect to the apparatus main body, and the optical writing unit 70 and the rotation axis 51 do not come into contact with each other.

Being configured in this manner, compared with the optical writing unit 70 supported at four points, the location to perform accurate alignment can be reduced, thereby manufacturing the printer at a low cost. Because the engaging unit does not come into contact with the rotation axis 51 at the operating position, it is possible to prevent the vibration of the rotation axis 51 from being directly transmitted to the optical writing unit 70. Accordingly, it is possible to prevent the abnormal images caused by vibration, such as color shifts and banding.

When the holding frame 130 is at the operating position, the optical writing unit 70 is supported by the left side plate 80, the right side plate 90, and the rear side plate 120. The left side plate 80 is the first support plate that supports one end of the photosensitive body 2 of the apparatus main body. The right side plate 90 is the second support plate that supports the other end of the photosensitive body 2. The rear side plate 120 is the perpendicular plate, perpendicular to the left side plate 80 and the right side plate 90. By supporting the optical writing unit 70 with the right side plate 90 and the left side plate 80, it is possible to carry out the alignment around a virtual axis that extends in the front-rear direction, in the rotation direction. By supporting the optical writing unit 70 with the rear side plate 120, it is possible to carry out the alignment around a virtual axis that extends in the left-right direction, in the rotation direction. Accordingly, it is possible to accurately align the optical writing unit 70 in the vertical direction.

The first alignment unit that aligns the left side plate 80 or the right side plate 90 of the optical writing unit 70 in the parallel direction is provided on the left side plate 80 and the right side plate 90. Accordingly, it is possible to align the optical writing unit 70 in the direction substantially perpendicular (front-rear direction) with respect to the rear side plate 120.

The second alignment unit that aligns the optical writing unit 70 at the operating position in the direction substantially perpendicular to the left side plate 80 or the right side plate 90 is provided, by moving the optical writing unit 70 close to the left side plate 80 or the right side plate 90. Accordingly, it is possible to align the optical writing unit in the direction substantially perpendicular (left-right direction) with respect to the left side plate 80 or the right side plate 90.

Particularly, it is preferable to configure the second alignment unit so that the optical writing unit 70 is aligned by moving the optical writing unit 70 close to the left side plate 80. The left side plate 80 is a support plate that supports the photosensitive body motor, which is a driving source, to rotate and drive the photosensitive body 2. The process unit including the photosensitive body 2 is aligned by being moved to the side of the left side plate 80 (the support plate), by which the photosensitive body motor is supported, so as not to be disengaged from the driving gear. Accordingly, by aligning the optical writing unit 70 by moving it close to the side of the left side plate 80, by which the photosensitive body motor is supported in the same direction as the direction that the process unit is being moved close to, it is possible to eliminate the shift between the photosensitive body and the optical writing unit 70, in the direction substantially perpendicular (left-right direction) with respect to the left side plate 80 or the right side plate 90.

The engaging unit 71*e* that is engaged to the rotation axis 51 is provided at least at the retracted position. The rotation axis 51 is disposed so that an upper portion of the rear side plate 120 and a part of the projected shape in the vertical direction are overlapped with the rear side plate 120. Being configured in this manner, the engaging unit 71*e* and the support protrusion 71*b* can be disposed close to each other, thereby preventing the positional fluctuation of the engaging unit 71*e* in the vertical direction, when the optical writing unit 70 is obliquely supported. Accordingly, even if the distance between the notch portion of the engaging unit 71*e* and the rotation axis 51 is small, it is possible to prevent the engaging unit 71*e* and the rotation axis 51 from coming into contact with each other at the operating position, when the optical writing unit is obliquely supported. Thus, it is possible to at least prevent the optical writing unit from wobbling in the holding frame, when the optical writing unit 70 is at the retracted position.

With the printer 99, it is possible to soften the impact when the notch portion of the engaging unit 71*e* is pressed against the rotation axis 51, while being rotated to the rotating position from the operating position. This is enabled by providing the elastic member 77*c* in the notch portion that is an engaging unit abutment location of the rotation axis 51, or a rotation axis abutment location of the engaging unit 71*e*. Accordingly, it is possible to prevent the breakage of the optical writing unit 70.

With the printer 98, the support protrusion 71*b*, which is the support unit, of the optical writing unit 70 supported by the rear side plate 120 is formed by components different from the casing of the optical writing unit 70. Accordingly, it is possible to easily adjust the height of the support protrusion 71*b*, compared with the support protrusion 71*b* and the casing 71 being integrally formed. It is also possible to enhance the yield, compared with the support protrusion 71*b* and the casing 71 being integrally formed.

It is also possible to prevent the rear side plate 120 from being abraded by the support protrusion 71*b*, when the support protrusion 71*b* slides on the rear side plate 120. This is enabled by forming the support protrusion 71*b* by material different from the casing 71 of the optical writing unit 70. Accordingly, it is possible to prevent the degradation of the alignment accuracy, caused because the portion that supports the support protrusion 71*b* of the rear side plate 120 is recessed.

Particularly, by forming the support protrusion 71*b* with a slidable material, the support protrusion 71*b* can slide well on the rear side plate 120, thereby preventing the abrasion of the rear side plate 120. Accordingly, it is possible to prevent degradation of the alignment accuracy.

With the printer 96, the housing unit that houses the controller 103, which is the controlling unit, to control the optical writing unit 70, is provided on the rear side plate 120. Accordingly, it is possible to eliminate the housing case that houses the controller 103, thereby reducing the number of the components.

By fixing a part of the harness 104 that electrically connects the optical writing unit 70 and the controller 103, to the harness clamp 105, which is a harness holding member, rotatably fitted on the rotation axis 51, it is possible to limit the loosening of the harness 104 between the harness clamp 105 and the optical writing unit 70, at the retracted position. Accordingly, it is possible to prevent the optical writing unit 70 from being pulled towards the side of the rear side plate, caused because the harness 104 is caught on the other components in the apparatus, when the optical writing unit 70 is rotated to the operating position from the retracted position. As a result, it is possible to prevent the optical writing unit 70 from coming into contact with the rotation axis 51 at the operating position.

With the printer 97, the right and left side alignment bosses 115 and 114 to fit to the rear side plate 120 are provided at each location of the left side plate 80 and the right side plate 90, respectively. The height of the left side alignment boss 114 of the left side plate 80 from the installation surface, and the height of the right side alignment boss 115 of the right side plate 90 from the installation surface are the same. Accordingly, when an external force and the like is applied from the left and the right directions of the printer, the right side plate 90 and the left side plate 80 can be rotated in the same direction at the same angle. Thus, the parallel relationship between the rotation axis 51 and the notch portion of the engaging unit 71*e* can be maintained. Therefore, compared with an arrangement that the rotation axis 51 is inclined with respect to the notch portion of the engaging unit 71*e*, the clearance between the rotation axis 51 and the notch portion of the engaging unit 71*e* can be narrowed. As a result, it is possible to prevent the optical writing unit 70 from wobbling in the holding frame, while the optical writing unit is being rotated.

The rotation axis 51 is laid across the left side plate 80 and the right side plate 90, in parallel with the notch portion, which is a rotation axis engagement location, of the engaging unit 71*e*. Accordingly, even if the position of the rotation axis 51 fluctuates downwards with respect to the engaging unit 71*e*, when the right side plate 90 and the left side plate 80 are inclined, it is possible to prevent the rotation axis 51 from coming into contact with the engaging unit 71*e*, compared with the rotation axis 51 obliquely supported with respect to the notch portion of the engaging unit 71*e*. Accordingly, compared with the rotation axis 51 obliquely supported with respect to the notch portion of the engaging unit 71*e*, it is possible to narrow the clearance between the rotation axis 51 and the notch portion of the engaging unit 71*e*. It is also possible to prevent the optical writing unit 70 from wobbling in the holding frame, while the optical writing unit is being rotated.

The number of components can be reduced by integrally forming the left side plate 80 and the right side plate 90 into an integral structure with resin.

With the invention according an aspect of the present invention, when the holder is at the operating position, the latent image writing unit is supported at three points with respect to the apparatus main body. Accordingly, it is only necessary to perform accurate alignment of the latent image writing unit in the vertical direction at three points, thereby reducing the manufacturing cost, compared with an arrangement that the optical writing unit 70 is supported at four points.

When the holder is at the operating position, the latent image writing unit does not come into contact with the rotation axis. Accordingly, even if the rotation axis is vibrated by a disturbance, the vibration does not directly transmit to the latent image writing unit, compared with an arrangement that the latent image writing unit and the rotation axis come into contact with each other, when the holder is at the operating position. Thus, it is possible to prevent the vibration of the latent image writing unit caused by a disturbance, compared with an arrangement that the latent image writing unit and the rotation axis come into contact with each other, when the holder is at the operating position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier that carries a latent image;

a latent image writing unit that carries out a writing operation to write the latent image on the latent image carrier; and a holding mechanism that holds the latent image writing unit, the holding mechanism being rotatable between an operating position and a retracted position around a rotation axis provided in an apparatus main body, the operating position being a position where the latent image writing unit carries out the writing operation and the retracted position being a position where the latent image writing unit does not carry out the writing operation, wherein the holding mechanism, when at the operating position, holds the latent image writing unit such that the latent image writing unit is supported at three points with respect to the apparatus main body, and the latent image writing unit and the rotation axis are not in contact with each other.

2. The image forming apparatus according to claim 1, wherein the apparatus main body includes a first support plate, a second support plate, and a third support plate that is substantially perpendicular to the first support plate and the second support plate and couples the first support plate and the second support plate, and when the holding mechanism is at the operating position, the first support plate supports a first part of the latent image carrier and the second support plate supports a second part of the latent image carrier.

3. The image forming apparatus according to claim 2, further comprising a first alignment unit that aligns the latent image writing unit in a direction substantially perpendicular to the third support plate on the first support plate and the second support plate.

4. The image forming apparatus according to claim 2, further comprising a second alignment unit that, when the holding mechanism is at the operating position, aligns the latent image writing unit in a direction substantially perpendicular to a mover support plate by moving the latent image writing unit toward the mover support plate, the mover support plate being one of the first support plate and the second support plate.

5. The image forming apparatus according to claim 4, wherein a driving-source support plate supports a driving source that rotates and drives the latent image carrier, and the second alignment unit aligns the latent image writing unit by moving the latent image writing unit toward the driving-source support plate, the driving-source support plate being one of the first support plate and the second support plate.

6. The image forming apparatus according to claim 2, wherein the latent image writing unit includes an engaging unit that engages with the rotation axis when the holding mechanism is at the retracted position, and the rotation axis is disposed so that an upper portion of the third support plate and a part of a projected shape in a vertical direction overlap with the third support plate.

7. The image forming apparatus according to claim 6, further comprising an elastic member attached to any one of the rotation axis and the engaging unit at an engaging location where the rotation axis is engaged with the engaging unit.

8. The image forming apparatus according to claim 2, wherein the latent image writing unit includes a support unit supported by the third support plate, and formed by a component different from a casing of the latent image writing unit.

9. The image forming apparatus according to claim 8, wherein the latent image writing unit includes the support unit supported by the third support plate, and formed by a material different from the casing of the latent image writing unit.

10. The image forming apparatus according to claim 9, wherein the support unit is formed of a slidable material.

11. The image forming apparatus according to claim 2, further comprising a housing unit that houses a controlling unit that controls the latent image writing unit, wherein the housing unit is coupled to the third support plate.

12. The image forming apparatus according to claim 11, further comprising a harness holding member rotatably fitted on the rotation axis, wherein the harness holding member holds a part of a harness that electrically connects the latent image writing unit to the controlling unit.

13. The image forming apparatus according to claim 2, wherein the first support plate is coupled to the third support plate via a first protruding member and the second support plate is coupled to the third support plate via a second protruding member, and the first protruding member and the second protruding member have equal protruding heights.

14. The image forming apparatus according to claim 13, wherein, when the holding mechanism is at the retracted position, the rotation axis is laid across the first support plate and the second support plate, in parallel with an engaging location of the rotation axis to an engaging unit of the latent image writing unit to be engaged to the rotation axis.

15. The image forming apparatus according to claim 14, wherein the first support plate and the second support plate are an integral structure integrally formed of resin.

* * * * *